United States Patent [19]

Shadle

[11] 3,974,724

[45] Aug. 17, 1976

[54] BAND SAW SAFETY GUARD

[75] Inventor: Jesse L. Shadle, West Chicago, Ill.

[73] Assignee: Plastofilm Industries, Inc., Wheaton, Ill.

[22] Filed: May 14, 1975

[21] Appl. No.: 577,604

[52] U.S. Cl. ..... 83/68; 83/360; 83/544; 83/814

[51] Int. Cl.[2] ..... B26D 1/46; B26D 7/24

[58] Field of Search ..... 83/68, 58, 360, 361, 83/397, 814, 544, 546

[56] References Cited

UNITED STATES PATENTS

| | | | |
|---|---|---|---|
| 1,369,824 | 3/1921 | McDonnell | 83/544 X |
| 3,648,552 | 3/1972 | Bradley | 83/544 X |
| 3,848,502 | 11/1974 | O'Neill | 83/544 X |

*Primary Examiner*—J. M. Meister
*Attorney, Agent, or Firm*—Darbo, Robertson & Vandenburgh

[57] ABSTRACT

A guard barrier in front of the exposed portion of the blade of a band saw is raised or lowered responsive to the elevation of the portion of the non-planar workpiece which is approaching the blade to be cut so that the varying length of exposed blade is continuously guarded without interfering with the cutting operation. A pneumatic cylinder controls the position of the guard barrier. Cam followers at the bottom end of the barrier ride along the uneven surface of the workpiece acting as a cam and follower movements operate a throttle valve which controls the pressure in the pneumatic cylinder to cause the barrier to move to and hover at its guarding location. An auxiliary valve is provided for rapid raising of the barrier to accommodate a steep rise on the workpiece, to broaden the range of useful operation in relation to workpiece profiles, and for manually controlled lifting of the guard.

An electric system is coordinated with the pneumatic system to provide control and safety features.

20 Claims, 13 Drawing Figures

6
23
24
40
9
2
5
41

6
5
35
26
40
42
9
2
24
23

14
13
7
11
43
10
62
4
12
3
6
5
3.
2
2.
9
2.
3.
1

25
18
23
32
29
31
32
9
23a
23a
24

6
21
12
20
20
19
19
6.
35
12
18
24
23a
23a
9
23
6.

COIL
COIL
COIL
COIL
ALARM
KEY RESET
FOOT SWITCH

BAND SAW SAFETY GUARD

BACKGROUND AND SUMMARY OF THE INVENTION

One of the most dangerous machines from the standpoint of serious accidental injury to the operator is the band saw. The ever present menace of the moving sharp teeth is aggravated by the high speed operation of the saw employed in industrial and commercial activities in order to maximize the efficiency of the operation. Even the slightest touching by a finger, movement or other body part results in serious injury. Even the realization of a close call is an enervating experience, frequently necessitating a recess for recovery from the shock caused by the knowledge and continuing fear of the consequences of an accident.

The use of a guard in front of the otherwise exposed length of the band saw is standard safety practice. When workpieces which are flat and of substantially uniform thickness are being cut, the provision of a guard presents no particular problem. It may be vertically adjustable for a particular job to allow passage of the workpiece under the bottom extremity of the guard with sufficient tolerance to avoid interference with the operation without leaving space for the entry of, for example, a finger. On the other hand, very difficult safety problems are posed in the sawing of workpieces which are uneven, varying in height above the saw table along the line of cut. A fixed guard must be high enough to permit the highest part of the workpiece to pass under it, leaving the dangerous exposed blade at lower levels of the workpiece at the cut.

The invention herein described provides a commercially practical solution to the hazards of cutting uneven workpieces with a band saw.

The primary object of the invention is to provide a band saw safety guard which automatically moves up and down responsive to the contour of the top surface of the workpiece; that is, the elevation of the guard changes continuously with the height of the workpiece in the vicinity of the part being cut so that the saw band that would otherwise be exposed above the workpiece while cutting lower levels is covered by the guard at all times during the cutting operation.

This object is achieved by arranging a vertically movable guard operated by a pneumatic system which, in turn, is controlled by a cam follower mounted at the bottom extremity of the guard to ride upon and respond to the changing elevational contours of the workpiece as it is moved by the operator into the saw. The top surface of the workpiece acts as a cam driving the follower in vertical movement which controls a valve of the pneumatic system, causing the guard to be elevated or lowered to reflect the instantaneous level of the workpiece at the cut.

A subsidiary object is to provide a guard control system having two aspects of guard movement, one being the normal up and down movement at response speeds adjusted to the particular job, the other being a very rapid lifting of the guard to meet extraordinary conditions such as a very steep workpiece incline approaching the blade or to provide restricted manual control.

A general object is to provide a band saw guard which provides maximum safety while causing minimum interference with the sawing operation; also to provide such a safety guard which is adjustable to adapt the band saw machine to a wide variety of sawing operations.

A further object is to provide safety features designed to protect the operator from a variety of possible hazards in the use of the band saw machine without unduly interfering with the efficient use of the machine.

DESCRIPTION OF THE DRAWINGS

In the accompanying drawings.

DESCRIPTION OF SPECIFIC EMBODIMENT

Figure 2:
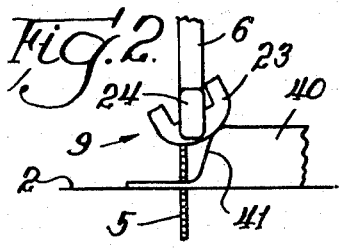
FIGS. 2 and 3 are detail views showing the camming action of the workpiece upon the pneumatic system control follower.

The apparatus illustrated in the drawings constitutes a refined embodiment of the invention in that particular shapes and arrangement of the air control cam follower means and optional aspects of the apparatus are designed and provided to achieve the ultimate in safety with a wide range of workpiece contour characteristics. Thus, although two air valves are shown to control elevation and ovement of the guard, only the lower, normal control valve, together with its cam follower control, is essential for normal operation of the band saw, the upper extraordinary control valve being provided to cope with workpieces having very steeply inclined contour characteristics and for the convenience, and therefore the efficiency, of the operator in certain circumstances.

Figure 1:
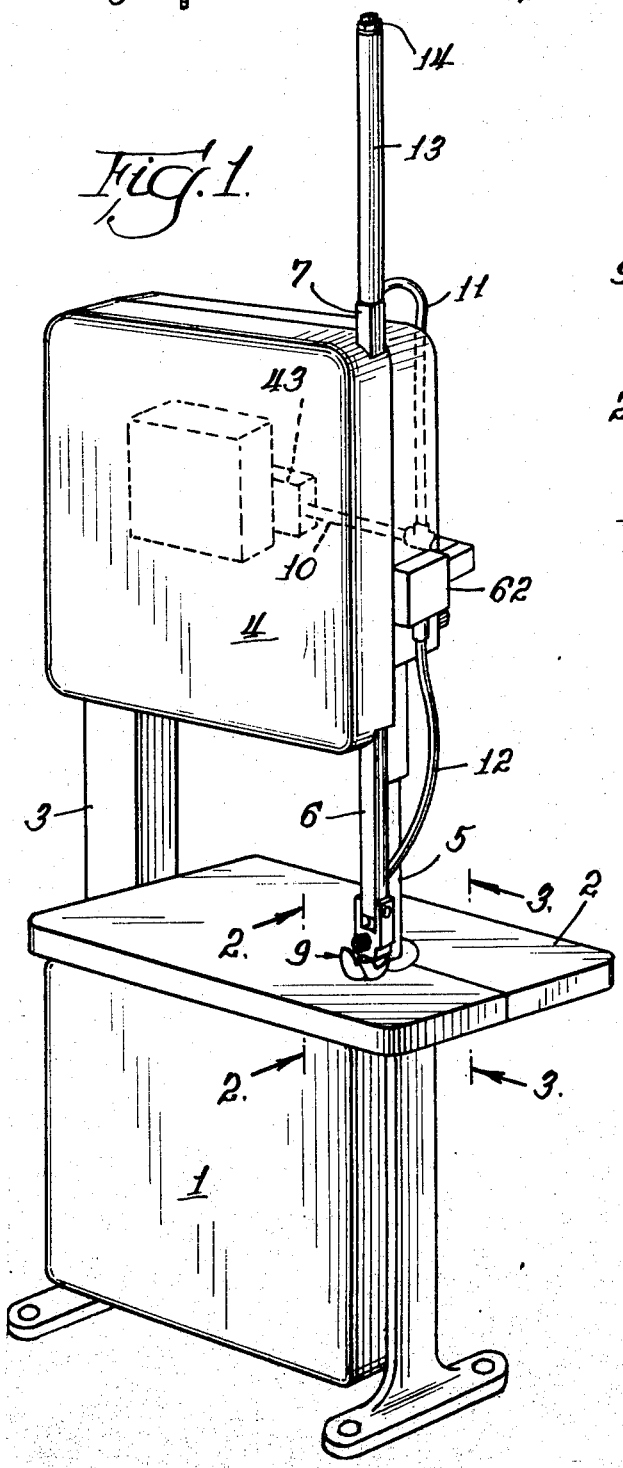
FIG. 1 is a perspective view of a band saw machine equipped with the safety guard of the invention.
Figure 10:
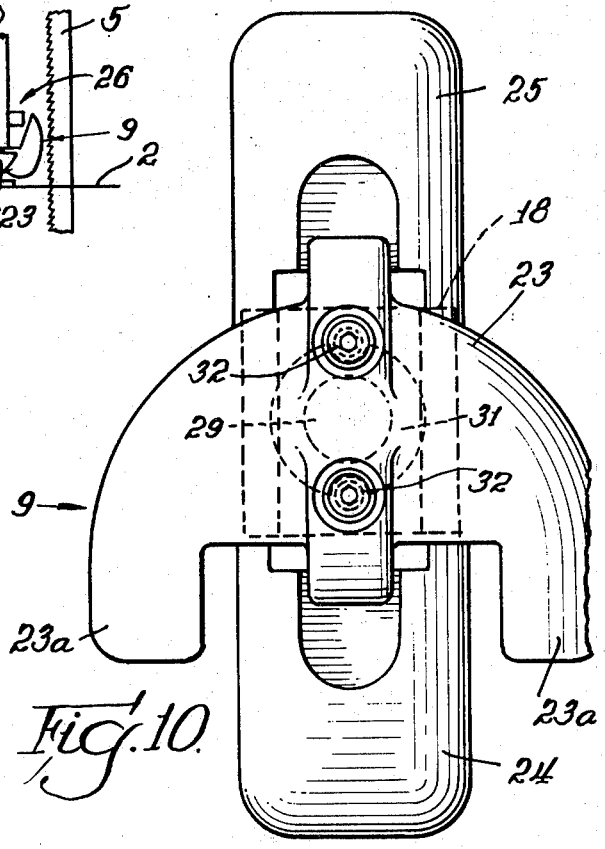
FIG. 10 is a bottom view of the cam follower apparatus at the lower extremity of the guard.
Figure 5:
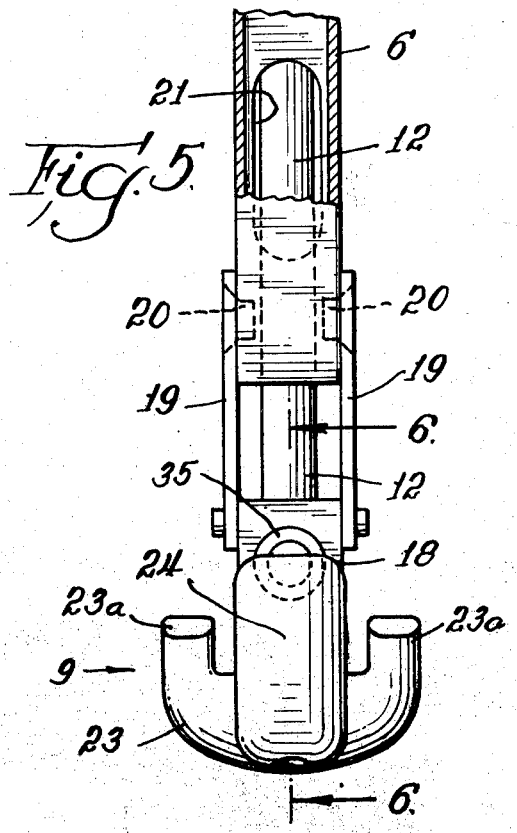
FIG. 5 is a view of the lower extremity of the guard including the cam follower and air valve apparatus, taken at the line 5—5 of FIG. 4.

The band saw illustrated in FIG. 1 is a typical industrial machine having the usual base 1 containing the drive mechanism, work table 2, column 3 supporting the upper structure 4, and saw band 5. Barrier guard 6 is arranged immediately in front of saw band 5 and is mounted to slide up and down within a fixed guideway 7. The pneumatic cylinder structure, is supported above and by guideway sleeve 7. The guard elevation controlling cam follower and air valve assembly 9 is mounted upon the bottom extremity of guard 6. Operating air supplied through tube 10 is connected both to the air cylinder through a rubber tube 11 and to the air control valves through rubber tube 12.

As will be seen as the description of the structure and operation of the apparatus is described, air passing through tube 12 to the cam follower-air valve assembly 9, which is the control head of the system, is normally exhausted to the atmosphere. The air is supplied under sufficient pressure to operate the pneumatic cylinder to elevate guard 6 only when the exhaust passageway is constricted by a control valve in the control head 9 to create back pressure in tube 11 and thus pressure in the pneumatic cylinder. It will be understood that the greater the degree of constriction of the passageway through the air control valves, the greater the back pressure exerting itself in the pneumatic cylinder and consequently the greater the lifting action and speed of elevation of the safety guard.

Figure 4:
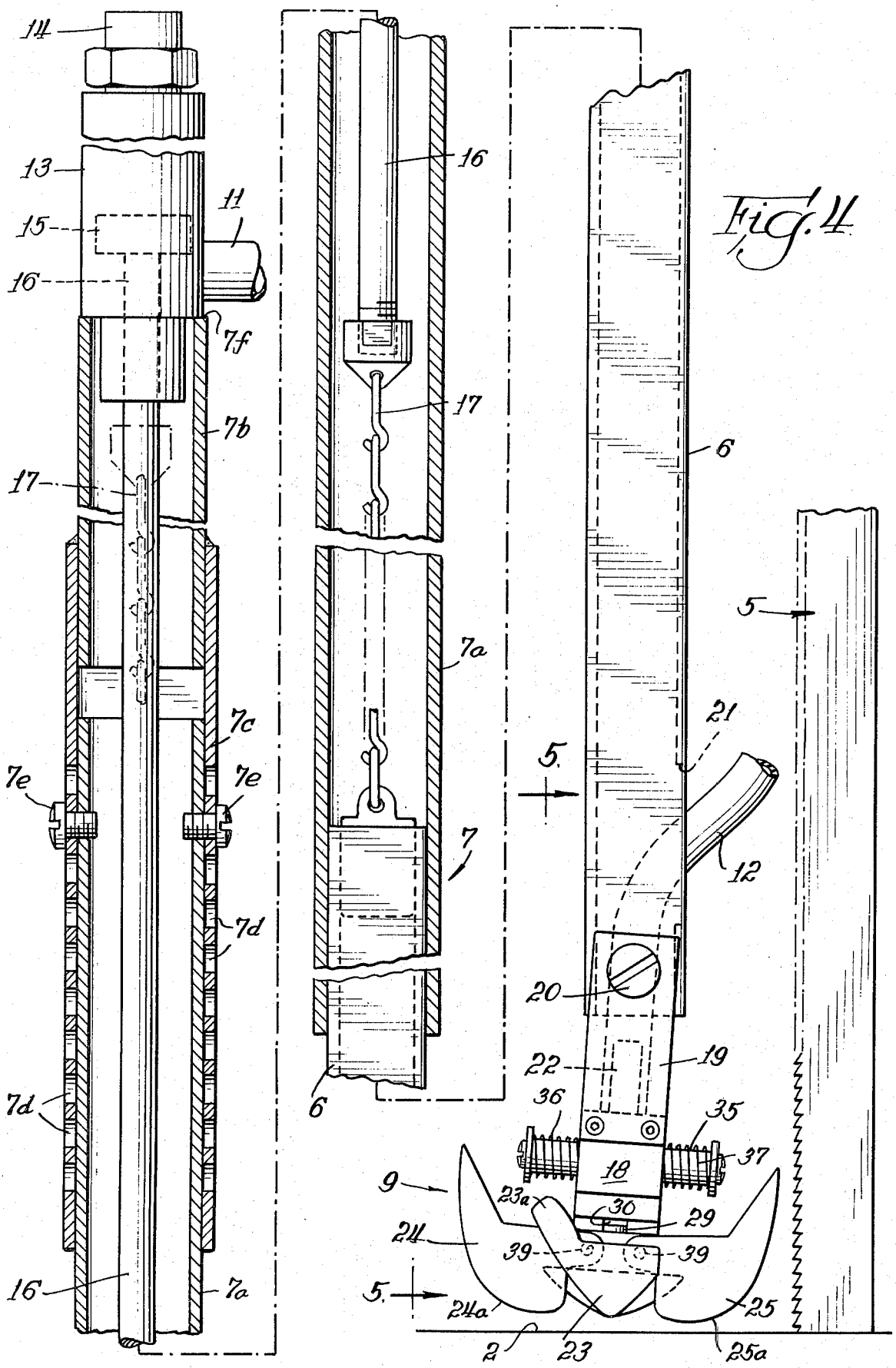
FIG. 4 is a side view, partly in section, showing the guard with its associated movement control apparatus.
Figure 7:
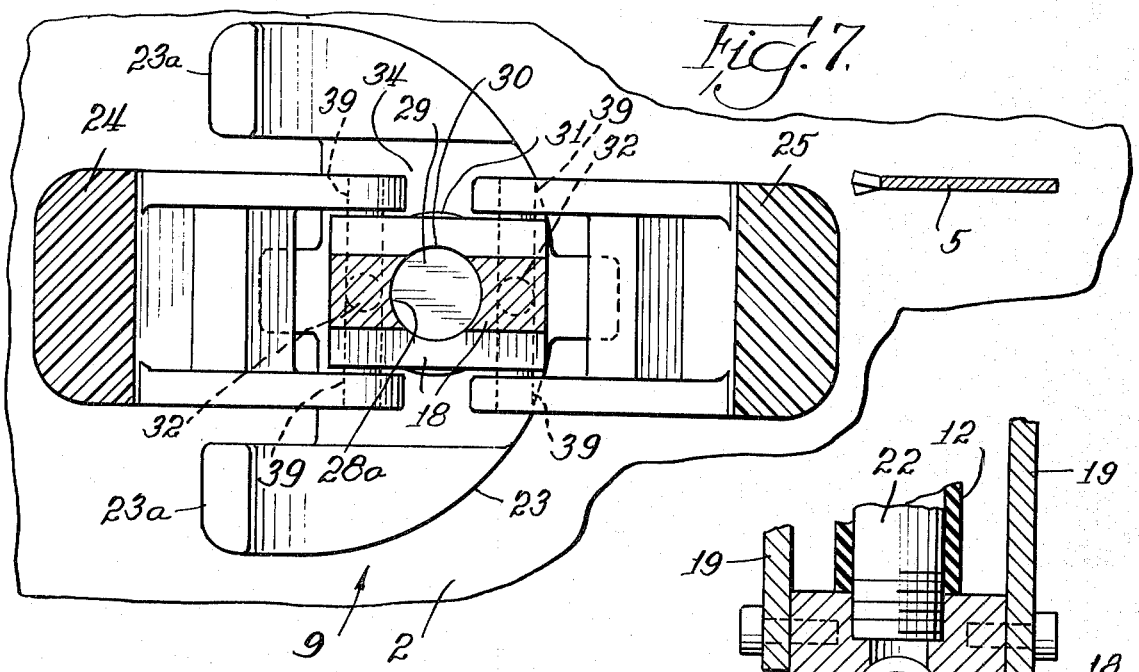
FIGS. 7 and 8 are cross-sectional views taken, respectively at the lines 7—7 and 8—8 of FIG. 6.
Figure 8:
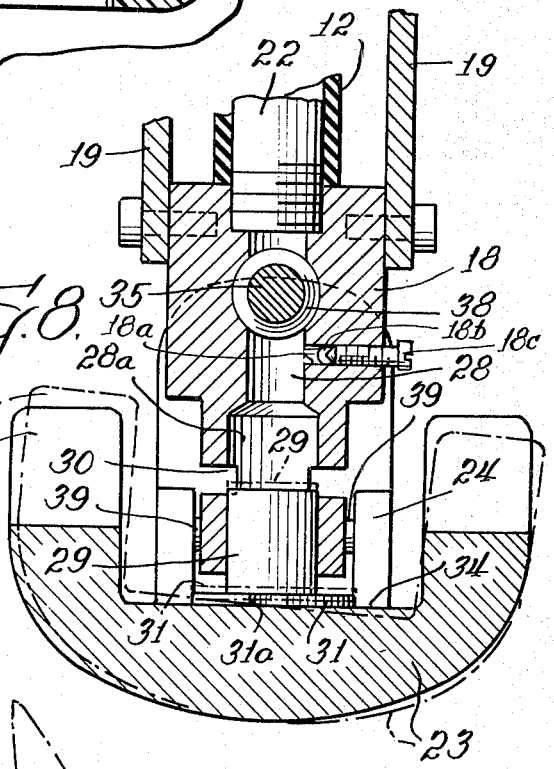
Figure 9:
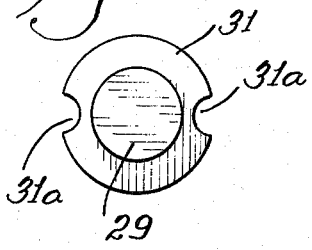
FIG. 9 is a top view of the movable valve plug of the lower, normal air control valve shown in FIGS. 6–8.

The construction of the safety guard and pneumatic lift and control system is illustrated in FIG. 4. Guard 6, which in the example shown is square in cross section, is arranged to slide up and down within fixed guideway 7. The guideway comprises a lower portion 7*a* which is mounted in superstructure 4 of the band saw machine and an upper portion 7*b* which includes a sleeve 7*c* having apertures 7*d* therein and is dimensioned to fit over the lower portion 7*a* and adjustably secured thereto by screws 7*e* to determine the level of the top extremity 7*f* of the fixed guideway. Pneumatic cylinder 13 is seated upon the top 7*f* of the fixed guideway. The top of the pneumatic cylinder is open to the atmosphere and is preferably equipped with a filter 14 to prevent the entrance of particles of any kind into the cylinder. Piston 15 of the pneumatic cylinder is connected to guard 6 to control the elevation of the same by means of piston rod 16 and chain 17. Thus, while the guard is pulled and held up by the action of the piston of the pneumatic cylinder, it moves downwardly by gravity as permitted by the piston.

The operation of the pneumatic cylinder is controlled by the cam follower-air valve system of control head 9 which is mounted and extends downwardly from the bottom end of guard 6. Valve body 18 is supported in position by a pair of arms 19 which are secured to the bottom end of guard 6 by means of screws 20. Air hose 12 passes through an opening 21 in the back of guard 6 and connects with nipple 22 which opens into the interior of the valve body.

In the particular embodiment of the invention illustrated in FIGS. 4–10, the cam follower system comprises what may be functionally termed a "normal" control valve follower 23 and an extraordinary control valve follower system comprising forward cam follower 24 and rearward cam follower 25.

To avoid misunderstanding, it should be here pointed out that for most uses of band saw machines, it is almost never necessary to back the workpiece away from the saw. Since rearward cam followr 25 would come into use only when the workpiece is moving against it; i.e., being backed away from the saw band, it may be omitted from the follower assembly as unnecessary (see FIG. 11). For the same practical reason, normal control valve follower 23 is not symmetrical fore and aft but is carried to its full operating coverage by the provision of fowardly extending wing portions 23*a*. Corresponding wing portions extending rearwardly have been omitted as unnecessary in the example shown. As will be seen hereinafter, provision is made for the lifting of the guard by manual control to enable the operator to execute special operations such as backing up the workpiece.

As will be understood from the following detailed description of the cam follower-air valve assembly, the cam followers are loosely hung from the bottom portion of valve body 18 to permit necessary operating movement.

The construction of the cam follower-air valve assembly 9 is shown in detail in FIGS. 5–10. As will be seen, a pair of valves, extraordinary control valve 26 and normal control valve 27, are arranged in series in the air passageway 28 in valve body 18. The normal control valve is a throttle valve which modulates the flow of air to the atmosphere from passageway 28 to control, by means to be described, the level of elevation of the guard in normal sawing operation. Except for relatively infrequently encountered situations, the extraordinary control valve is wide open to permit full flow through passageway 28 to the normal control valve. The closing of extraordinary control valve 26 results in the rapid lifting of the guard, possibly to the limit of its movement. Since this valve is intended under certain circumstances to pre-empt normal operation of the guard system, it is located upstream from the normal control valve 27.

The normal control valve comprises a plug 29 which is located for vertical, axial movement in the lower end of counterbore 28*a* at the lower end of air passageway 28. Air exhaust ports 30 are more or less constricted, depending upon the position of valve plug 29 which, in turn, is controlled by cam follower 23 acting as a wobble plate upon head 31 of the valve plug.

Cam follower 23 is loosely hung below valve body 18 by means of screws 32. Indentations 31*a* in the valve plug head 31 provide clearance for the screws. The under surfaces of the follower are gently curved, as shown in the drawing, to permit the workpiece to slide along under the follower as it is fed into the saw. The curved follower surfaces continuously engage and respond to the undulating top surface of the workpiece acting as a cam. The top, central area surface 34 of follower 23 is flat, being horizontal when the band saw is not in operation or when the top surface of the workpiece is flat and horizontal. The flat head 31 of valve plug 29 rests upon follower surface 34. Acting as a wobble plate, the tilting of follower 23 in any direction about screws 32 acting as pivots causes upward movement of the valve plug with a resulting degree of constriction of air exhaust ports 30. Similarly, elevation of the follower as a whole, as when riding on a plateau of the workpiece, raises the valve plug to correspondingly restrict flow through the exhaust ports. As noted above, this results in the exertion of a back pressure in air line 12 and diversion of a part of the air stream to hose 11 which activates the pneumatic cylinder system to lift the guard 6. When the moving workpiece no longer applies tilting or upward pressure to the cam follower, it levels and/or lowers itself, permitting valve plug 29 to fall under the influence of gravity and air pressure, uncovering air exhaust ports 30 accordingly and permitting the escape of air therethrough.

At some point, in the normal operation of the control system, the rising of the barrier responsive to the inclination of the surface of the workpiece is arrested as the surface levels off or starts to decline. At a plateau of the workpiece surface, the barrier hovers in position, hunting almost imperceptibly (if the air system is properly adjusted) to maintain its desired position guarding the saw blade. Except when at rest at its lowermost position, the guard position control system is a dynamic system, constantly responding to changing pressures applied to the followers of the control head by the workpiece as the elevation of its surface changes or as the elevation of the barrier is changed by the pneumatic cylinder. Although dynamic, the system is also stable when properly constructed and adjusted as herein specified.

Figure 6:
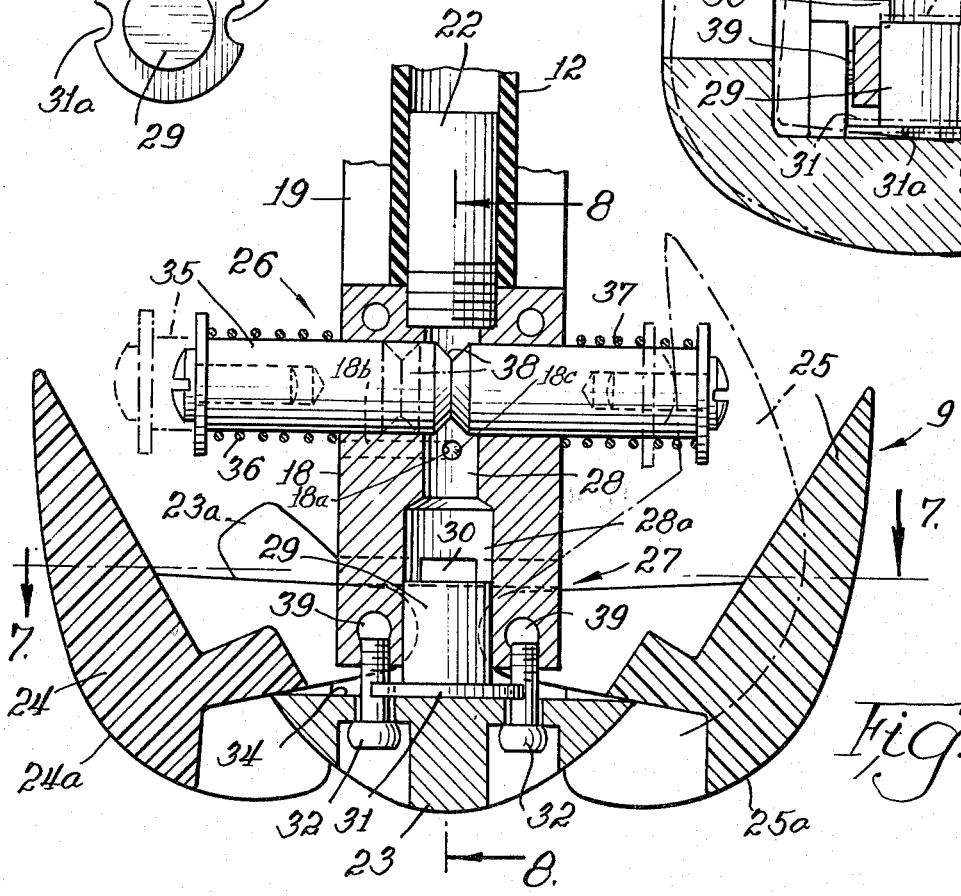
FIG. 6 is an enlarged cross-sectional view of the cam follower and air valve control apparatus at the lower extremity of the guard, taken at the line 6—6 of FIG. 5.

For optimum operating characteristics of the safety guard system, provision is made for the escape of some air to the atmosphere, even when valve plug 29 of the normal control valve is at its uppermost position. This may be arranged as shown in FIG. 6, by providing ports 30 which are not completely closed when head 31 of valve plug 29 is stopped by the bottom of valve body 18, by providing an orifice, possibly adjustable, in the valve body downstream from the extraordinary control valve plug 35, or simply by providing a generous tolerance, say 0.001 inch, between valve plug 29 and center bore **28*a*** in which it reciprocates. The space provided by the last expedient has the additional advantage of ensuring unimpeded operation of the valve in a cushion of air.

The provision for a bleeding flow of air, as just described, has the effect of slowing somewhat the response of the pneumatic cylinder to signals transmitted by the cam followers. This is desirable, within limits, to control hunting. The slower response of the system can be tolerated when workpieces have moderately undulating surfaces or when the quick-acting extraordinary valve control is used along with the ordinary valve control. An adjustable bleed may be provided if desired to provide an additional means of controlling the sensitivity of the ordinary control valve and more easily adapt a machine to workpieces having different surface profile characteristics. To this end, a hole **18*a* (FIG. 8) may be provided in body 18 with an air escape vent 18*b* connecting the hole with the atmosphere. A set screw 18*c*, threaded into the outer portion of hole 18*a*, serves as an adjustable needle valve to control the opening through which air from passageway 28** may escape to the atmosphere.

As will be seen, hunting can also be controlled by adjusting the rate of flow of operating air to the control system.

As already noted, extraordinary control valve 26 is intended to be either fully open or fully closed. In the embodiment shown in FIG. 6, valve plug 35 is floated in a stable central position by means of opposing coil springs 36 and 37, with air passage groove 38 located in air passageway 28 so that at its position of repose, valve 26 is open for the passage of air through to normal control valve 27. Valve plug 35 may be moved in either axial direction in the valve body by pressure applied at an end of the plug by either forward cam follower 24 or rearward cam follower 25. These followers have smoothly curved surfaces **24*a* and 25*a* and are respectively pivotally mounted by means of pins 39 to the bottom of valve body 18**.

Extraordinary control valve 26 is shown in closed position in dot-dash lines in FIG. 6 as a consequence of the movement of follower 25 to the position shown in dot-dash lines. Normal control valve 27 is shown in partly closed position in dot-dash lines in FIG. 8 under the influence of the cam follower shown slightly tilted in dot-dash lines.

As is shown in FIG. 4, the cam follower-air valve assembly 9 is slightly cocked to present its bottom at a very small angle to the oncoming workpiece. It has been found by experience that this slight tilting of the assembly enhances the smooth operation of the cam followers.

OPERATION OF PNEUMATIC GUARD ELEVATOR SYSTEM

When the band saw is on and running either without a workpiece in position for cutting or with a workpiece that is thin and flat being cut, air continuously supplied through tube 10 passes through tube 12 and is exhausted continuously through exhaust ports 30 in the control valve body. Back pressure resulting from resistance to flow is not sufficient to cause air flow through tube 11 into pneumatic cylinder 13 to effect any lifting of guard 6. The operator is fully protected by the guard from the otherwise exposed saw band.

Figure 3:
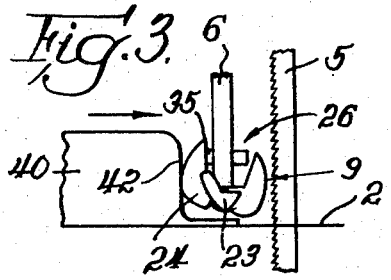

Examples of the action of the cam follower and guard system when cutting a workpiece 40 which has an uneven top surface are illustrated in FIGS. 2 and 3. As the elevated portion 41 of the workpiece (FIG. 2) approaches saw band 5, the surface of the workpiece, acting as a cam bearing against the curved undersurfaces of cam follower 23, tilts the follower, as shown, which action moves normal control valve 29 upwardly to constrict air exhaust port 30, throttling down the flow of air to the atmosphere. The normal passageway being thus constricted, air flowing through tube 10 is diverted, in part, through tube 11 into pneumatic cylinder 13, and guard 6 is lifted by piston 15 acting through rod 16 and chain 17. The rate and extent of elevation of guard 6 corresponds to the degree of constriction of ports 30 by the normal control valve. A relatively steep incline in the surface of the workpiece causes correspondingly greater tilting of follower 23 with correspondingly greater flow of air into the pneumatic cylinder and more rapid lifting of guard 6. When, by reason of the lifting of guard 6 and the cam follower 23, or with the lowering of the level of the top of the workpiece approaching the saw, follower 23 is permitted to return to a less tilted or lower position, valve plug 29 is correspondingly permitted to move downwardly and permits increased resumption of flow of air to the atmosphere through ports 30. When the valve, as controlled by cam follower 23, is opened sufficiently, air in the pneumatic cylinder, under pressure of the weight of the guard and elevator system, flows out through hoses 11 and 12, permitting the guard to fall by gravity.

Thus, as the workpiece is moved into the saw, the guard is lifted as inclined surfaces approach the saw band to prevent interference with the sawing operation by the guard and is again permitted to fall as the surface of the workpiece drops away. At the crest of a hill or along a plateau of the workpiece, or at any elevated level, the guard hovers in position, moving slightly up and down as it seeks its optimum position just above the workpiece with the cam followers gently engaging the workpiece surface.

An example of the operation of the extraordinary control valve is illustrated in FIG. 3. As workpiece 40 is moved toward the saw band 5, the guard is confronted by a very steep, almost vertical, rise 42. The camming action of the workpiece rotates forward cam follower 24 about its pivot until the follower engages and moves valve plug 35 to closed position, shutting off the flow of air through passageway 28 to divert the entire flow of air through tube 11 into the pneumatic cylinder, effecting the very rapid lifting of the guard to permit passage of the workpiece with minimum interference. Release of the follower by the workpiece cam surface permits the resumption of normal flow of air through tube 12 and passageway 28, subject to the action of the followers and constriction of the air flow responsive to the contours of the workpiece as movement into the saw is continued.

An adjustable balancing and sensitivity valve 43 may advantageously be interposed in air supply line 10 to adjust the rate of flow of air to the guard control system. The amount of air supplied must be adjusted to the air flow characteristics of exhaust ports 30 as constricted by control valve plug 29 and the fixed exhaust bleed so that the guard will be lifted properly as required by the contours of the workpiece. When properly balanced, the engagement pressure between workpiece and cam follower surfaces is on the order of a few ounces.

The movement characteristics of the guard may be altered by adjustment of this sensitivity valve. Greater air flow will tend to counterbalance the system, resulting in a faster response rate of elevation and a slower lowering of the guard. Reduction in the rate of flow through the sensitivity valve will effect a slower lifting rate and faster dropping of the guard. Hunting can be minimized by adjustment of the sensitivity valve in coordination with the flow valve of the minimum exhaust bleed. The air flow characteristics may be further adjusted to balance the system and meet the needs of particular jobs by adjusting the position of follower 23 with respect to valve body 18 by means of screws 32. Ports 30 may thus be partly constricted at maximum open position of the valve.

Alternative and Modified Embodiments

Figure 11:
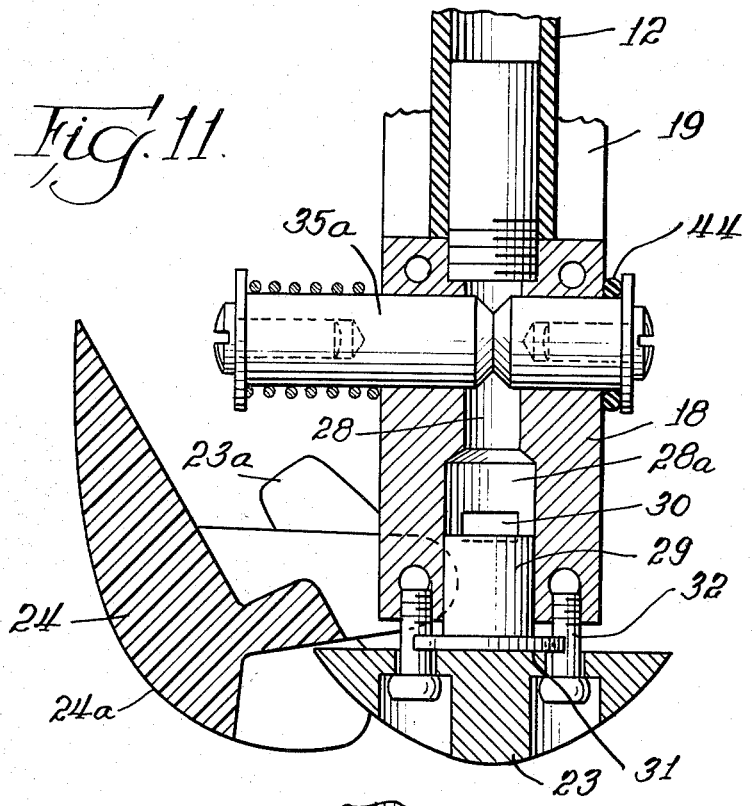
FIG. 11 is a detail view, in cross section, showing a modified form of the cam follower-extraordinary control valve apparatus.

If, in the use of a particular band saw machine, it is unlikely that it will become necessary to back up the workpiece as a part of the sawing operation, rearward cam follower 25 may be omitted. Such a cam follower-control valve assembly is shown in FIG. 11. In addition to the simple omission of follower 25, valve plug **35*a* is made single acting, an O-ring 44 being used in place of the coil spring at the rearward end of the valve plug. The extraordinary control valve is thus subject to closing only by the action of forward cam follower 24**.

Figure 12:
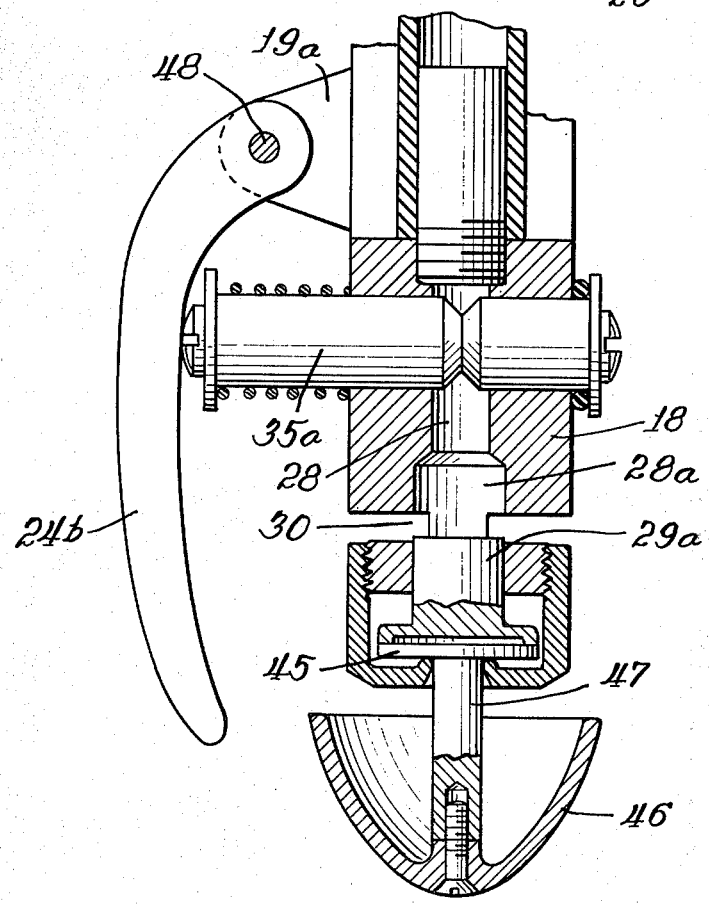
FIG. 12 is a detail view, in cross section, showing the simplest form of normal control valve cam follower.

A simple form of normal control valve having a full 360° response range is that illustrated in FIG. 12. Valve plug **29*a* is moved up and down to throttle the flow of air through air exhaust ports 30 by a wobble plate 45 which is rigidly attached by post 47 to ellipsoidal cam follower 46. Sidewise or upward movement of the cam follower causes corresponding upward movement of valve plug 29*a* to effect the lifting of the guard barrier as above described. In the position shown in FIG. 12**, the valve is open to the maximum extent and the guard is accordingly at its lowermost position.

Although the essential objects of the invention may be achieved by the employment of a normal control valve, only, the assembly illustrated in FIG. 12 is shown with a modified form of extraordinary control valve. Cam follower **24*b* is pivoted to structural arm 19*a* by means of a pin or bolt 48. This follower hangs loosely against the projecting end of valve plug 35*a* pending depression by contact therewith of an elevated position of a workpiece being fed into the saw. In the manner above described, the closing of the extraordinary control valve by inward movement of follower 24*b*** causes the rapid lifting of the guard so that sawing of the workpiece may continue.

INTEGRATED SAFETY SYSTEM FOR OPERATION

Figure 13:
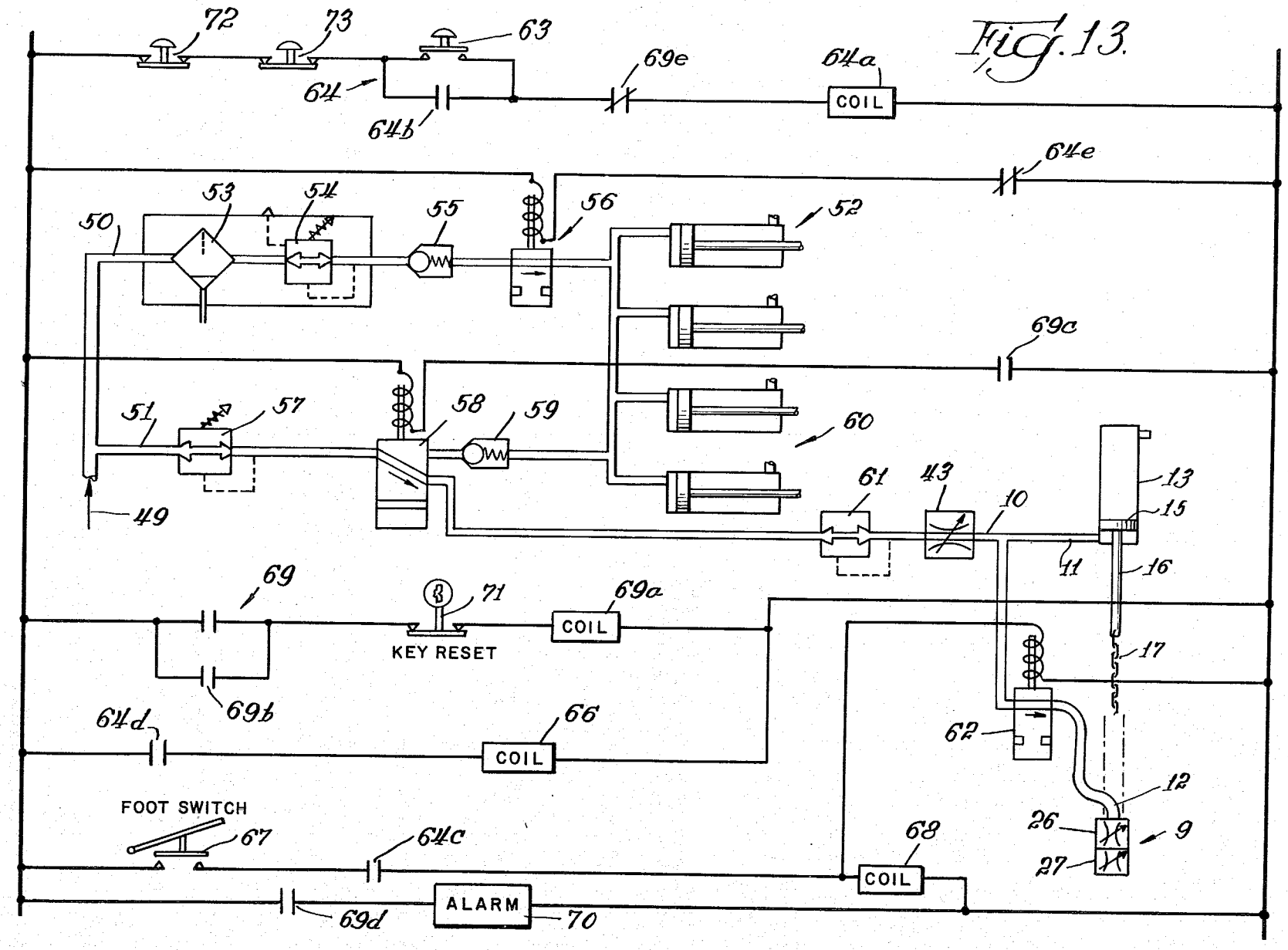
FIG. 13 is a combined pneumatic and electric control diagram.

A comprehensive operating safety system is integrated with the band saw safety guard. The elements and arrangement of this system are represented in the combined pneumatic and electric circuits of FIG. 13. The system includes manually actuated means for lifting the guard barrier out of the way, timing means for limiting the duration of the unguarded condition, and emergency brakes and an alarm requiring the attention of supervisory personnel to reset the machine for operation. A time lag for the rapid lifting of the guard responsive to operation of the extraordinary control valve is also built in due to the compressibility of the air in the system to contribute to the prevention of injury resulting from the unintended touching of the cam follower by the hand of the machine operator.

These and related safety aspects of the invention will be described as the description of the operation of the band saw machine proceeds with reference to the pneumatic and electric operating and control systems.

The operating and control air system is shown with double lines to indicate tubing or hose. The air is supplied to the system as indicated by arrow 49. Branch line 50 supplies air for the standard brakes for the band saw machine and branch 51 supplies air for the emergency brakes and for the operation of the safety guard.

Air for operating standard brakes 52 passes through a suitable sump 53, pressure reducer 54 and check valve 55 and is supplied at approximately 20 p.s.i. to standard brakes 52 through, and as controlled by, solenoid valve 56.

Air is supplied to branch 51 through pressure regulator 57 at about 60 p.s.i. In the normal position shown of solenoid valve 58, the operating air is connected through to the safety guard apparatus. In the other position of solenoid valve 58, the relatively high pressure air is conducted through check valve 59 to emergency brakes 60. Another pressure regulator 61 reduces the pressure supplied through adjustable sensitivity valve 43 to the barrier control system.

As has already been explained, air from supply line 10 is connected by rubber hose 11 to the pneumatic cylinder 13 and by rubber hose 12 to the control head 9 which includes extraordinary control valve 26 and normal control valve 27. Solenoid valve 62 is interposed in the line leading to hose 12 and the control air valves to shut off the flow of air and divert the entire flow to the pneumatic cylinder under certain circumstances.

The electric system is shown as that when the power is off and the band saw machine is not operating. If operating air under pressure is connected to the system, standard brakes 52 are set.

Assuming that the power and air are connected to the machine, it is started by closing starting switch 63 of control relay 64, energizing relay coil **64*a* which closes lock switch 64*b* and switches 64*c* and 64*d* and opens switch 64*e*. Solenoid valve 56 is closed with the opening of switch 64*e* to release standard brakes 52. At the same time, power is supplied to the band saw machine motor by relay 66 which is actuated upon the closing of switch 64*d***.

The machine is now running with operating air being supplied through solenoid valve 58 to the barrier control system. Valve 43 is manually adjusted to permit the optimum flow of air to the control system to provide desired operating characteristics as above described.

Normally open solenoid valve 62 is interposed in the air line to the cam follower-air valve assembly 9 to make it possible, by means described below, to lift the barrier guard 6 out of the way, voiding the automatic control system.

Although it is desirable to make it possible for the operator to lift the barrier guard out of the way in using the band saw, as, for example, to start the sawing operation on a new workpiece or meeting a special condition beyond the ability of the automatic controls to handle, it is also highly desirable to minimize the duration of the unguarded condition because of the great danger involved. Provision is accordingly made to ensure minimal use of the unguarded saw.

Solenoid valve 62 can be closed by the manual closing of foot switch 67 by the machine operator. Upon the closing of switch 67, timer relay 68 is activated for the purpose of limiting the duration of the voiding of the automatic guard control. The timing span is manually adjustable and is usually set by supervisory personnel to impose the shortest reasonable time on the machine operator. If the foot switch 67 is reopened by the operator prior to the expiration of the time for which timer 68 is set, solenoid valve 62 is reopened and the timer is reset to beginning. If, however, foot switch 67 is held in closed position for a period longer than that permitted by the timer, the timer switch closes to operate relay 69 by energizing relay coil 69*a* which closes and locks switch 69*b* and closes switches 69*c* and 69*d* and opens and locks switch 69*e*. The result is the immediate shutdown and stopping of the saw. The opening of switch 69*e* shuts off power to the motor while the closing of switch 69*c* operates solenoid valve 58 to supply air to emergency brakes 60 which are applied immediately. Standard brakes 52 are also applied by virtue of the closing of switch 64*e* and opening of the solenoid valve 56 which it controls. At the same time, an alarm 70, which may comprise a bell, flashing lights, etc., is activated to call the attention of supervisory personnel. In this condition, the machine is inoperable and can not again be put into service without opening the timer and alarm circuit as by means of a key reset switch 71. The opening of this normally closed switch re-establishes conditions ready for again starting the machine by starting switch 63.

Manually operable stop switches 72 and 73 may be provided at appropriate locations, such as at the front and at the rear of the band saw machine.

ACHIEVEMENT

The band saw safety guard system herein described provides maximum protection to the operator without unduly interfering with the efficiency of the sawing operation. It has adjustability features and the cam follower head makeup is variable so that the guard is readily adaptable to the peculiar requirements of different categories of workpieces and to different machine structures. Provision is also made for coping with extraordinary problems requiring the temporary voiding of the safety guard system subject to supervisory control. Use of the guard greatly reduces the hazard of operating band saw machines.

I claim:

1. A safety guard system for a band saw machine having a saw blade and supporting structure, comprising, in combination, an elongated barrier mounted vertically in said structure for vertical reciprocation along in front of said blade, and means for raising or holding in fixed position or permitting the gravity lowering of said barrier responsive to the elevation of the undulating top surface of a workpiece as it approaches said saw blade; said means comprising single acting pneumatic cylinder means connected with said barrier for elevating the same, a control head mounted at the bottom end of said barrier, said control head comprising a valve body having an air passageway therethrough opening to the atmosphere, means for continuously supplying air under pressure to said air passageway with connection to said pneumatic cylinder means, valve means arranged in said body to vary and control the rate of flow of air through said passageway, and cam follower means mounted at the bottom of said control head in operative connection with said valve means to restrict the flow of air through said passageway proportionately to the degree and direction of movement of said cam follower means to thereby modulate the air flow to and from said pneumatic cylinder means, said cam follower means being adapted to ride upon the top surface of a workpiece as it approaches said saw blade and move with changing elevation of said surface.

2. A safety guard system in accordance with claim 1 wherein the control head is mounted directly to the bottom end of the barrier.

3. A safety guard system in accordance with claim 1 wherein the means for continuously supplying air includes a manually adjustable valve for adjusting the rate of flow of air to the guard system to predetermine the rate of movement of the barrier and to balance the pneumatic system and control the sensitivity thereof.

4. A safety guard system in accordance with claim 1 wherein the air passageway has a permanently open bleed outlet to the atmosphere whereby the valve means can constrict but not entirely stop the flow of air through said passageway.

5. A safety guard system in accordance with claim 1 wherein the air passageway has a bleed outlet to the atmosphere and an adjustable valve for controlling the rate of flow of air through said outlet to the atmosphere to thereby adjust the sensitivity of the valve means of the system.

6. A safety guard system in accordance with claim 1 and including means for temporarily voiding said system with the barrier held in elevated position, said voiding means comprising a voiding valve in the air supply line to the air passageway in the valve body downstream from the connection to the pneumatic cylinder means, and manually operable means for closing and reopening said valve.

7. A safety guard system in accordance with claim 6 and including timer means connected with the manually operable means and the voiding valve to limit the time during which the guard system is voided.

8. A safety guard system in accordance with claim 7 and including means for shutting down the band saw machine upon the expiration of a preset time limit during which the guard system is voided.

9. A safety guard system in accordance with claim 7 and including alarm means for actuating the same upon the expiration of a preset time limit during which the guard system is voided.

10. A safety guard system in accordance with claim 8 and including alarm means and means for activating the same concurrently with the shutting down of the machine.

11. A safety guard system in accordance with claim 8 and including means for supervisory control of the restarting of the machine comprising a key reset switch, the timer means including means for opening said reset switch upon the expiration of the preset time limit during which the guard system is voided.

12. A safety guard system in accordance with claim 1 wherein the valve means comprises two valves arranged in series in the air passageway in the valve body, cam follower means being operatively and respectively connected to each of said valves.

13. A safety guard system in accordance with claim 12 wherein the cam follower means includes a cam element extending forwardly from the control head and arranged to affect the position of the upstream valve and sense steep increases in elevation of a workpiece being fed into the saw whereby to effect the rapid raising of the barrier responsive to said last mentioned elevation.

14. A safety guard system in accordance with claim 13 wherein the cam follower means also includes a cam element extending rearwardly from the control head and arranged to affect the position of the upstream valve and sense steep increases in elevation of a workpiece being withdrawn from the saw whereby to effect the rapid raising of the barrier responsive to said last mentioned elevation.

15. A safety guard system in accordance with claim 12 wherein the passageway has a permanently open bleed outlet to the atmosphere downstream from the upstream of the two valves therein whereby the upstream valve is capable of entirely shutting off the flow of air through said passageway and the downstream valve can constrict but not entirely stop the flow of air through said passageway.

16. A safety guard system in accordance with claim 1 wherein the air passageway includes a vertical cylindrical portion opening at the bottom of the valve body and the valve means includes a cylindrical valve plug arranged for axial movement within said cylindrical portion, said passageway having an outlet port in the wall thereof at a location at which it may be covered or uncovered by said valve plug within the limits of movement thereof, the cam follower means being operatively connected with said valve plug to constrict the flow of air from said passageway to the atmosphere proportionately to the degree and direction of movement of said follower from its position of repose.

17. A safety guard system in accordance with claim 12 wherein the air passageway includes a vertical cylindrical portion opening at the bottom of the valve body and the valve means includes a cylindrical valve plug arranged for axial movement within said cylindrical portion, said passageway having an outlet port in the wall thereof at a location at which it may be covered or uncovered by said valve plug within the limits of movement thereof, the cam follower means being operatively connected with said valve plug to constrict the flow of air from said passageway to the atmosphere proportionately to the degree and direction of movement of said follower means from its position of repose.

18. A safety guard system in accordance with claim 16 wherein the valve plug terminates at its bottom with an annular flange, the cam follower means comprising a follower element having smoothly curved under surfaces and a flat top surface, said follower element being loosely hung below the valve body with said valve plug flange resting upon said flat top surface whereby said valve plug is moved responsive to the movement of said follower element with said flat top surface acting as a wobble plate.

19. A safety guard system in accordance with claim 16 wherein the valve plug terminates at its bottom with an annular flange, the cam follower means comprising an ellipsoidal follower element having an axial post extending vertically upwardly and terminating at its top with a horizontal circular plate, said annular flange resting upon said circular plate, said follower means being supported with freedom for lateral movement of said follower element in any direction whereby said valve plug is moved responsive to the movement of said follower element with said plate acting as a wobble plate.

20. A safety guard system in accordance with claim 19 wherein the valve means include a valve arranged in the air passageway upstream from the valve plug and the cam follower means includes a follower element operatively connected with said upstream valve independently of the ellipsoidal follower element.

* * * * *

UNITED STATES PATENT AND TRADEMARK OFFICE

CERTIFICATE OF CORRECTION

PATENT NO. : 3,974,724

DATED : August 17, 1976

INVENTOR(S) : Jesse L. Shadle

It is certified that error appears in the above-identified patent and that said Letters Patent are hereby corrected as shown below:

| | |
|---|---|
| Col. 1, l. 12 | "movement" should read --hand-- |
| Col. 2, l. 46 | "ovement" should read --movement-- |
| Col. 7, l. 63 | "position" should read --portion-- |
| Col. 10, l. 64 | after "alarm means" insert --and means-- |

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*